US005426824A

United States Patent [19]

Gloor et al.

[11] Patent Number: 5,426,824

[45] Date of Patent: Jun. 27, 1995

[54] METHOD FOR PRODUCING NONWOVEN WEBS FROM UNORDERED FIBRES

[75] Inventors: René Gloor, Richterswil; Alfred Beeler, Horgen, both of Switzerland

[73] Assignee: Zellweger Luwa AG, Uster, Switzerland

[21] Appl. No.: 204,335

[22] PCT Filed: Jul. 13, 1992

[86] PCT No.: PCT/CH92/00142

§ 371 Date: May 16, 1994

§ 102(e) Date: May 16, 1994

[87] PCT Pub. No.: WO94/01610

PCT Pub. Date: Jan. 20, 1994

[51] Int. Cl.[6] ..... D04H 1/74

[52] U.S. Cl. ..... 19/296; 19/115 A; 19/129 R

[58] Field of Search ..... 19/96, 101, 108, 115 A, 19/129 R, 296, 297

[56] References Cited

U.S. PATENT DOCUMENTS

| | | | |
|---|---|---|---|
| 1,936,443 | 11/1933 | Abbott | 19/155 A |
| 3,474,502 | 10/1969 | Pohland | 19/161 |
| 3,626,552 | 12/1971 | Walker et al. | 19/129 R |
| 4,400,853 | 8/1983 | Nagel | 19/129 R |
| 5,068,947 | 12/1991 | Beeler | 19/297 X |

FOREIGN PATENT DOCUMENTS

| | | |
|---|---|---|
| 0247420 | 12/1987 | European Pat. Off. . |
| 0419830 | 4/1991 | European Pat. Off. . |
| 450775 | 2/1936 | United Kingdom . |
| 1306345 | 2/1973 | United Kingdom . |

OTHER PUBLICATIONS

N. Schlumberger & Cie. NSC, "Intersectingstrecke GN 6", Jul. 1992.

N. Schlumberger & Cie. NSC, "Kettenstrecke GC13", Jul. 1992.

*Primary Examiner*—John J. Calvert

*Attorney, Agent, or Firm*—Burns, Doane, Swecker & Mathis

[57] ABSTRACT

A method for producing uniform nonwoven webs from a supply of unordered fibre material includes discharging a quantity of fibre material onto a needle-type transport system having needles which are movable along a transport path, taking-up the fibre material by way of the needles on the needle-type transport system, transporting the fibre material in the needle-type transport system to an end of the transport system, discharging the fibre material onto an opening roller, separating the discharged fibre material on the opening roller and transferring the fibre material which has been separated on the opening roller onto a cylinder. An apparatus for producing uniform nonwoven webs includes a needle-type transport system for transporting fibre material along a transport path, an opening roller positioned along the transport path adjacent one end of the transport system and a rotatable cylinder positioned adjacent the opening roller for receiving the fibre material from the opening roller.

26 Claims, 3 Drawing Sheets

METHOD FOR PRODUCING NONWOVEN WEBS FROM UNORDERED FIBRES

FIELD OF THE INVENTION

The invention relates to a method for producing uniform nonwoven webs from unordered fibre material, and to an apparatus for carrying out such a method.

BACKGROUND OF THE INVENTION

There are numerous methods and appliances for the qualitative and quantitative testing of textile fibres. In many test methods, the unordered fibre material, for example cotton in flock form, cannot be measured immediately, but must first be processed into nonwoven webs having a parallelized fibre position. These webs are then used as test samples for obtaining measured quality values on the fibre material and, in the form of continuous nonwoven webs, as a preliminary step in the manufacture of threads or yarns from the fibre material.

Known appliances for the opening of fibre flocks consist conventionally of a pair of feed rollers and of an opening drum. A subsequent cylinder receives the opened material, and then stores it or transports it further. The pair of feed rollers ensures controlled material guidance which is imperative in view of the high degree of opening necessary in the fibre flocks. In such opening appliances for fibre flocks, there is a need to produce the desired sliver, if possible, without the fibre being damaged. Appliances of this type according to the state of the art, for example cards, have a high throughput, but, at the same time, the fibres are nevertheless damaged to a considerable extent. In cards according to the state of the art, it is also already known to structure the feed rollers, for example by the formation of spirals on the surface of the feed rollers or on a clothing having elements arranged in the direction of run and resembling small hooks. These structures have primarily the function of preventing the fibres from adhering to the rollers. A selective retention of the fibres is not possible with these structures, thus leading to increased fibre damage in the fibre samples obtained thereby.

During the feed Of unordered fibre material by means of a pair of feed rollers to an opening roller provided with a "card clothing", the fibre material is opened and a uniform nonwoven is obtained from it. During this, the pair of feed rollers moves preferably at a lower circumferential speed than the opening roller. At least one feed roller can likewise be provided with a "card clothing", the elements of this "clothing" extending counter to the direction of rotation of the feed roller. The pair of feed rollers retains the still unordered fibre material selectively along a line, while the "card clothing" of the opening roller continuously seizes some of the fibres and opens them. A nonwoven is then obtained from these on the subsequent folding roller.

In textile technology, the "card clothing" of a roller is meant to describe phrase the attachment of a series of narrow bands on the outer surface of the roller, which are equipped with small teeth or small hooks usually inclined either in the direction of rotation or counter to this. Likewise, a corresponding design of the outer surface of the roller itself, which can be obtained, for example, by engraving or rolling and by means of which small teeth or small hooks are attached to the outer surface of the roller, can also be designated as a clothing. For the sake of brevity, such small teeth and small hooks will be combined hereafter under the term "small hooks".

In the method mentioned, the individual fibres of the unordered fibre material are retained only along a line. Now if the opening roller draws on a longer fibre, then the remaining fibres behind the retaining line are drawn towards the feed rollers. There is consequently always an excess of fibre material between the feed rollers, thereby increasingly reducing the selective effect of the clothing on one of the two feed rollers. Finally, the fibre material is clamped again. Now if a fibre is seized by the opening roller, then the retaining force is so high that the fibre is torn off. The resulting nonwoven web therefore no longer fully possesses the quality features of the unordered fibre material and consequently can no longer be considered as a completely representative test sample. However, the torn-off pieces of the long fibres also have a quality-reducing effect on the yarn when the nonwoven web is used as a preliminary stage in yarn production.

Furthermore, EP-B1-0,247,420 discloses an appliance for ordering the ends of fibres for fibre-length measurement, in which a nonwoven is introduced into a needle-type transport device consisting of a plurality of needle combs and is transported intermittently by this to a gripper device, by means of which a sample can be extracted from the nonwoven. The needle-type transport device in this known appliance consists of a "needle bed". This term is meant to describe a series of parallel combs which are equipped with needles and which can be moved transversely relative to the comb direction. While the nonwoven is at rest, the comb of the needle bed which is the foremost in the transport destination direction is moved into the last position of a lower comb series having an opposite direction of transport. The comb located in the foremost position and belonging to this lower comb series is simultaneously moved back into the needle bed as the rearmost comb. During transport, the needle bed has no appreciable influence on the orientation of the fibres in the nonwoven. The needle bed serves merely to retain the nonwoven while a part sample is being obtained in order to determine the fibre-length distribution.

Further needle-type transport systems, already on the market, of N. Schlumberger & Cie. NSC are known, for example under the designation "Intersectingstrecke GN 6" ["Intersecting drafting frame GN 6"] (Company prospectus Intersectingstrecke GN6, pages 8/9, and Company prospectus GN6, page 5) or "Kettenstrecke GC13"["Chain drafing frame GC13"] (Company prospectus, page 5), in which, instead of a gripper (as in EP-B1-0,247,420), a pair of rollers is mounted, and by means of this slivers or nonwovens can be combed, unfelted and folded. However, these known needle-type transport systems or needle-type drafting frames are not suitable for the opening of unordered fibre material.

The object on which the invention is based is to provide a method by which a uniform nonwoven web can be produced from unordered and unopened fibre material better than in the disclosed methods, along with the greatest possible preservation of the fibre quality, especially the fibre-length distribution.

Further advantageous embodiments of the invention are described below.

BRIEF DESCRIPTION OF THE DRAWING FIGURES

Two exemplary embodiments of the invention, which at the same time explain the operating principle, are illustrated in the drawings and are described in more detail below, in which.

DETAILED DESCRIPTION OF THE INVENTION

Figure 1:
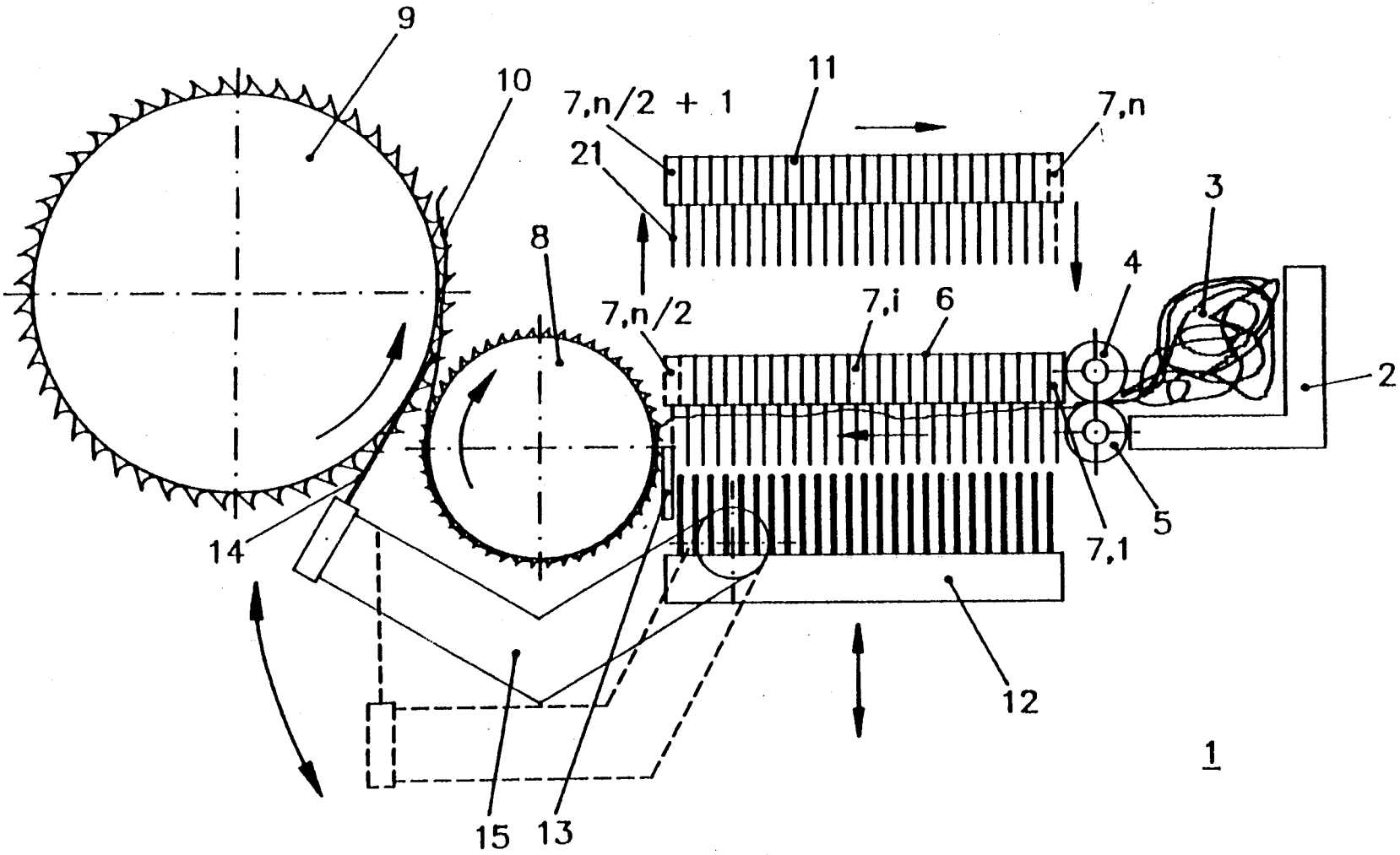
FIG. 1 shows a diagrammatic representation of an apparatus for carrying out the method according to the invention.

The apparatus 1 illustrated in FIG. 1 consists of an open supply container 2, in which unordered fibre material 3 is located, a pair of feed rollers 4, 5 with a first feed roller 4 and a second feed roller 5, and a needle bed 6 with an upper comb series 11 and a lower comb series 12. The needle bed 6 consists of individual combs 7,i which are equipped with needles that engage into a still unopened nonwoven web 10 to be manufactured by the apparatus and which move from the pair of feed rollers 4,5 in the direction of the opening roller 8 by means of a transport device (not shown). Further details of the needle bed 6, especially relating to its transport device, are described in EP-B1-0,247,420 and, moreover, are known from the abovementioned appliances on the market, for example of N. Schlumberger & Cie.

The opening roller 8 is followed by a cylinder 9, preferably in the form of a folding roller, on which the opened fibres are folded, thus finally resulting in the opened nonwoven web 10.

Since the circumferential speed of the opening roller 8 is much higher than the transport speed of the needle bed 6, the fibres seized by the opening roller 8 are immediately drawn out of the nonwoven and are transported as individual fibres onto the cylinder 9, with the result that a uniform opened nonwoven web 10 is obtained. The fibre tufts of differing density are thus opened by means of this drawing-out operation.

The unordered and unopened fibre material 3 located in the supply container 2 is continuously seized and discharged by the pair of feed rollers 4,5 in quantities which are small in comparison with this supply. At the same time, the nonwoven web 10 is preformed between the feed rollers 4,5, runs by means of the combs 7,*i* of the needle bed 6 to the opening roller 8 and further to the cylinder 9 (preferably in the form of a folding roller), with the conversion of the unordered fibre material 3 into a nonwoven web 10 consisting of opened fibres being perfected with each transfer.

The needle bed 6 runs slightly faster than the circumferential speed of the feed rollers 4,5, so that no lap can occur between the feed rollers 4,5. The pair of feed rollers 4,5 discharges the quantities of fibre material 3 to be drawn off onto the needle bed 6 which consists of combs 7,*i* movable individually in the direction of the nonwoven web 10 and equipped with needles. The needles of the combs 7,*i* take up the fibre material 3. As a result of this operation, the fibre material 3 is converted into a nonwoven web 10. In the textile industry, the term "opening" is meant to describe the increase in the state of order of a fibre structure, highly entangled fibres being drawn apart from one another or "separated". This opening takes place during the transfer of the nonwoven web 10 onto the opening roller 8.

The transport device (not shown) of the needle bed 6 additionally causes the following movements: the particular comb 7,*n* closest to the feed rollers 4,5 in the upper comb series 11 is transferred, in the course of the transport movement, into the comb position 7,*l* closest to the feed rollers 4,5 in the needle bed 6. At the same time, the comb 7,*n*/2 closest to the opening roller 8 in the needle bed 6 is transferred into the comb position 7,*n*/2+1 closest to the opening roller 8 in the upper comb series 11. Thus, the combs 7,*i* are continuously exchanged cyclically and are moved along the needle bed 6 by means of the transport device. The movement of the transport device can take place continuously or intermittently. The needle bed 6 must expediently be longer than the largest fibre length which occurs.

Located on the side of the needle bed 6 on which the nonwoven web 10 runs is a pressing-in device 12 which moves towards the needle bed 6 and back again, at the same time passing through between the combs 7,*i* and repeatedly pushing the nonwoven web 10 back into the needle bed 6. As a result, in contrast to the "needle-type drafting frames" according to the state of the art, the work can be carried out with a one-sided needle bed.

Figure 2:
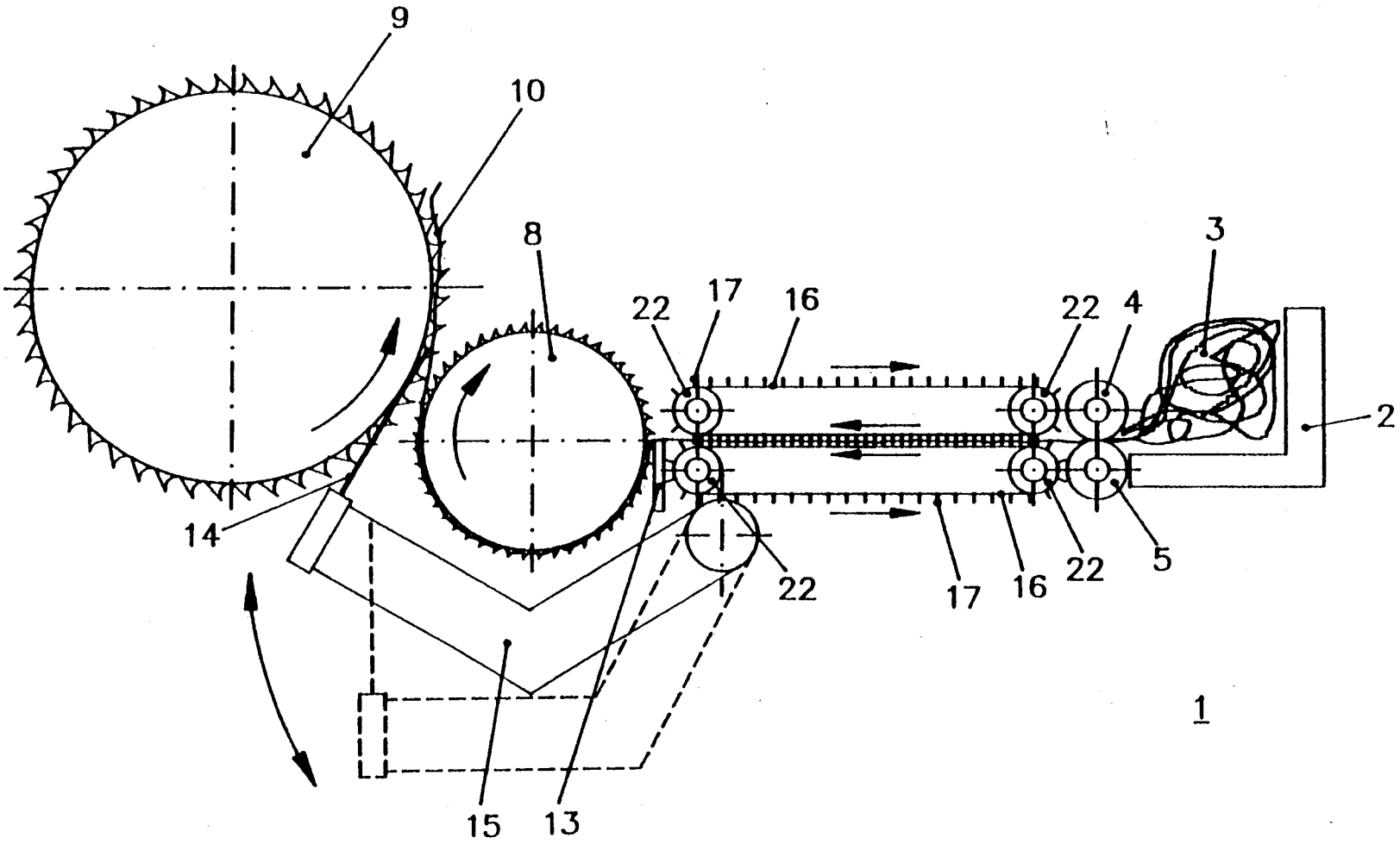
FIG. 2 shows a diagrammatic representation of a modified apparatus for carrying out the method according to the invention.

As shown in FIG. 2, the needle bed 6 can also take the form of a pair of needle bands 16. The two needle bands 16 equipped with needles 17 run on two respective pairs of drive cylinders 22. The drive cylinders 22 can be driven electromotively (not shown in the drawing) and can be controlled together with the remaining elements of the apparatus 1. The two needle bands 16 are arranged parallel to one another in such a way that their needles 17 can engage in one another and thereby take up the fibre material 3. For this purpose, the respective pairs of drive cylinders 22 of the two needle bands 16 are to be moved in opposition, so that the parts of the two needle bands 16 bearing on one another move towards the opening roller 8 in the same direction.

The remaining elements of this modified apparatus are already described in connection with FIG. 1. The advantage of this modified version is a mechanism which involves little outlay and which is therefore cheaper.

In the two embodiments according to FIG. 1 or 2, a limiter 13 is expediently installed between the opening roller 8 and the needle-type transport device 6;16 and prevents the fibres from being lifted vertically out of the needles 7;17 by the opening roller 8, thus resulting in a reduction in the retaining force and impaired opening.

A holding-down device 14 is expediently mounted on a lever 15 between the opening roller 8 and the cylinder 9 (preferably in the form of a folding roller). In the case of a multi-layer application of the nonwoven web on the cylinder 9, this holding-down device 14 ensures that the fibre fractions or fractions of nonwoven web previously applied to the latter are held down, for example before a new fraction of nonwoven web is added.

At least one of the feed rollers 4,5 can possess knobs, that is to say nipple-like elevations on its outer surfaces, or a clothing having small hooks counter to their running direction, in order to bring about a better fibre draw-in.

The opening roller 8 is expediently equipped with a clothing, the small hooks of which lie in the direction of run of the opening roller 8. The cylinder 9, preferably taking the form of a folding roller, should also be equipped with a clothing having small hooks in the direction of run, so that the opened fibres on the opening roller 8 can be received. The circumferential speed of the cylinder 9 must be higher than that of the opening roller 8.

The variations in fibre-length distribution are minimal in the method according to the invention. The opening according to the invention of the fibres takes place between the needle-type transport device 6;16 and the opening roller 8. The needle-type transport device 6;16 generates the retaining force and the opening roller 8 the drawing-out force. These two forces must be coordinated with one another in the best possible way; if the two forces are too high, the fibre is torn apart; if the two forces are too low, the opening which can be achieved is poor. The advantage of the method according to the invention is that the retaining force is selective and over a large area. Selective means, in this respect, that each fibre is retained individually according to its length by a few needles. In the conventional clamping method according to the state of the art, the fibres are clamped along a line, thus resulting in an excessively high retaining force and therefore in fibre damage. As regards retention along a line, the fibres are increasingly compacted behind the retaining line, thus leading to an increase in the retaining force and to damage to the fibres.

Figure 3:
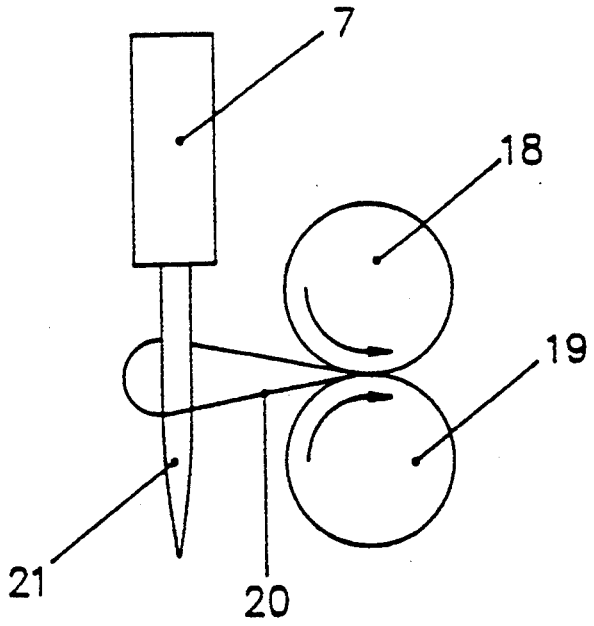
FIG. 3 shows a partial section through a needle-type drafting frame according to the state of the art.
Figure 4:
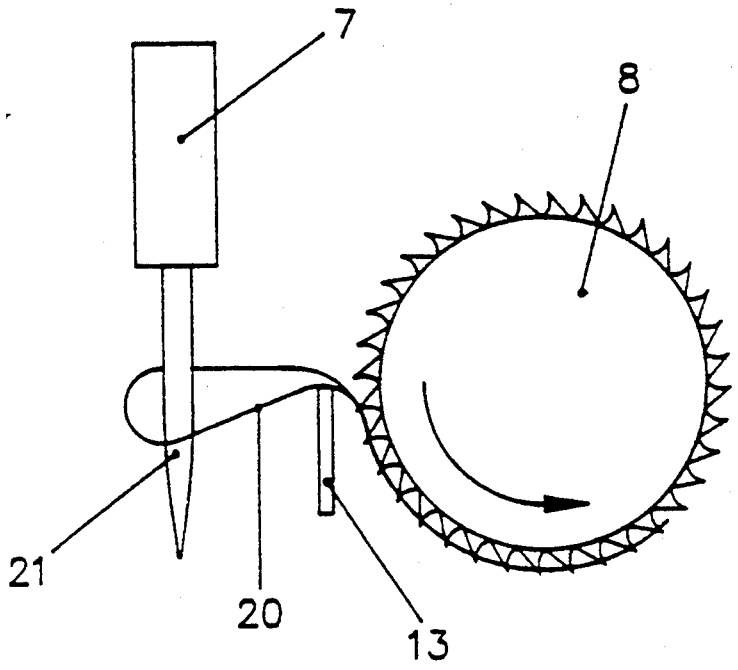
FIG. 4 shows a partial section, similar to that of FIG. 3, through an apparatus according to the invention.

FIGS. 3 and 4 illustrate the problem of small hooks of fibre. As shown in FIG. 3, in the methods according to the state of the art, the situation can arise that the needle tip 21 of the needle comb 7 is surrounded by a fibre 20 forming a closed loop. If, as in the state of the art, the drawing-off device consists of a pair of rollers 18,19 which clamps the fibres along a line and which thus draws them out of the fibre material, then the fibre 20 is necessarily destroyed.

As shown in FIG. 4, in the method according to the invention this problem is solved by the use of an opening roller 8 having clothings. The fibre 20 forming a small hook is received by the opening roller 8 only when the retaining needle is removed. The drawing-off forces are therefore likewise selective, in contrast to the clamping line in the "needle-type drafting frame" according to the state .of the art (FIG. 3). In the method according to the invention, therefore, the fibre-length distribution is better preserved than in the methods disclosed hitherto.

The method according to the invention thus achieves the object of producing a uniform nonwoven web 10 from unordered fibre material 3 better than the disclosed methods, along with the greatest possible preservation of the fibre quality, especially the fibre-length distribution.

We claim:

1. Method for producing uniform nonwoven webs from a supply of unordered fibre material comprising:

A) discharging a quantity of fibre material onto a needle-type transport system having needles which are movable along a transport path in a material flow direction;

B) taking-up the fibre material by way of the needles;

C) transporting the fibre material on the needle-type transport system to an end of the transport system and then discharging the fibre material onto an opening roller;

D) separating the discharged fibre material on the opening roller; and

E) transferring the discharged fibre material which has been separated on the opening roller onto a cylinder in the form of a nonwoven web.

2. Method according to claim 1, wherein the fibre material is discharged onto the transport system by way of a pair of feed rollers.

3. Method according to claim 1, wherein the needle-type transport system is a needle bed comprised of combs which are movable individually in the direction of the nonwoven web to be formed and which are equipped with the needles.

4. Method according to claim 3, including a transport device which moves the combs of the needle bed in series in the direction of the transport path.

5. Method according to claim 4, wherein the transport device transfers the comb of the needle bed which is closest to the opening roller into a comb position closest to the opening roller in an upper comb series, and also transfers the comb of the upper comb series which is closest to the feed rollers into a comb position closest to the feed rollers in the needle bed to thereby effect a continuous cyclic exchange of the combs in which the combs in the needle bed move from the feed rollers to the opening roller and the combs in the upper comb series move from the opening roller to the feed rollers.

6. Method according to claim 4, wherein the fibre material is transported continuously.

7. Method according to claim 4, wherein the fibre material is transported intermittently.

8. Method according to claim 3, including retaining the nonwoven web in the needle bed by a pressing-in device which passes between the combs.

9. Method according to claim 8, wherein the combs of the needle bed are moved by a transport device, the pressing-in device being moved by the transport device.

10. Method according to claim 1, wherein the needle-type transport system comprises two needle bands which are arranged parallel to one another, and including moving the two needle bands by means of drive cylinders, the needle bands being equipped with needles which can engage in one another along parts of the two needle bands which face one another in order to move the fibre material.

11. Method according to claim 2, wherein the circumferential speed of the feed rollers is lower than the speed of the needles of the needle-type transport system.

12. Method according to claim 3, wherein the speed of the needles of the needle-type transport system is lower than the circumferential speed of the opening roller.

13. Apparatus for producing uniform non-woven webs from a supply of unordered fiber material comprising a needle-type transport system for transporting fibre material along a transport path, an opening roller positioned along the transport path adjacent one end of the transport system, and a cylinder positioned adjacent the opening roller for receiving the fibre material from the opening roller.

14. Apparatus according to claim 13, including two feed rollers positioned at an end of the transport system opposite the opening roller.

15. Apparatus according to claim 13, wherein the needle-type transport system comprises a needle bed with combs, a pressing-in device (12) and an upper comb series (11).

16. Apparatus according to claim 13, wherein the needle-type transport system comprises two needle bands which are arranged parallel to one another, the needle bands being movable by means of drive cylinders and being equipped with needles which engage in one another along parts of the two needle bands which face one another.

17. Apparatus according to claim 14, wherein at least one of the feed rollers has a clothing with small hooks positioned counter to the direction of rotation of the feed roller.

18. Apparatus according to claim 13, wherein an outer surface of at least one feed roller has knobs.

19. Apparatus according to claim 13, wherein the outer surface of the opening roller has a clothing with small hooks arranged in the direction of rotation of the opening roller.

20. Apparatus according to claim 13, wherein the cylinder is a folding roller, an outer surface of the folding roller having a clothing with small hooks arranged in the direction of rotation of the cylinder.

21. Apparatus according to claim 13, including a holding-down device mounted on a lever between the folding roller and the opening roller.

22. Apparatus according to claim 13, wherein the length of the needle bed is longer than the greatest length of fibre.

23. Apparatus according to claim 13, including a limiter for retaining the fibres within the needle-type transport system, said limiter being positioned between the opening roller and the needle-type transport system.

24. Apparatus for providing a uniform opened nonwoven web from a supply of unordered fibre material comprising:

a feed device for feeding unordered fibre material;

a movable needle bed positioned adjacent the feed device for receiving unordered fibre material from the feed device and for transporting the fibre material as a nonwoven web in a transport direction, said needle bed including a plurality of needles which engage and transport the fibre material during movement of the needle bed;

a rotatable opening roller positioned adjacent an end of the needle bed for drawing out fibres from the nonwoven web of fibres transported by the needle bed and for carrying the drawn-out fibres to produce a uniform opened nonwoven web of fibres; and a rotatable cylinder positioned downstream of the rotatable opening roller bed with respect to the transport direction for receiving the uniform opened nonwoven web of fibres from the opening roller.

25. Apparatus according to claim 24, wherein the needle bed transports the fibre material at a transport speed, the circumferential speed of the opening roller being greater than the transport speed of the needle bed.

26. Apparatus according to claim 25, wherein the feed device includes two feed rollers which rotate at a circumferential speed that is less than the transport speed of the needle bed.

* * * * *